US005129565A

United States Patent [19]

Miller

[11] Patent Number: 5,129,565

[45] Date of Patent: Jul. 14, 1992

[54] REFILLABLE SHEET MATERIAL DISPENSER

[76] Inventor: Joseph W. Miller, 16 Timberleigh Ct., Manchester, 63021

[21] Appl. No.: 643,440

[22] Filed: Jan. 22, 1991

[51] Int. Cl.[5] ..... B65H 75/32; B26F 3/02

[52] U.S. Cl. ..... 225/38; 225/42; 225/77; 225/90

[58] Field of Search ..... 225/34, 37, 38, 77, 225/90, 42, 81; 242/55.3, 55.53

[56] References Cited

U.S. PATENT DOCUMENTS

| | | | |
|---|---|---|---|
| 392,502 | 11/1888 | Earl | 225/38 |
| 650,456 | 5/1900 | Duncan | 225/38 |
| 2,322,456 | 6/1943 | Krueger | 242/55.53 |
| 2,550,209 | 4/1951 | Tuttle | 242/55.3 |
| 2,722,387 | 11/1955 | Tuttle | 242/55.3 |
| 2,819,851 | 1/1958 | Robertson | 225/38 |
| 2,858,086 | 10/1958 | Saphier | 225/38 |
| 2,943,777 | 7/1960 | Dvoracek | 225/38 |
| 3,156,392 | 11/1964 | Jonannes | 225/38 |
| 3,603,519 | 9/1971 | Brown | 242/55.3 |
| 3,738,552 | 6/1973 | Roeder | 225/80 |
| 4,502,621 | 3/1985 | Thatcher | 225/16 |
| 4,645,107 | 2/1987 | Norris | 225/37 |
| 4,762,042 | 8/1988 | Denter et al. | 83/374 |
| 4,762,259 | 8/1988 | Kosa | 225/37 |
| 4,779,780 | 10/1988 | Scharf | 225/42 |

FOREIGN PATENT DOCUMENTS

| | | | |
|---|---|---|---|
| 2632518 | 1/1978 | Fed. Rep. of Germany | 225/37 |
| 4721 | 4/1884 | United Kingdom | 225/37 |

*Primary Examiner*—Hien H. Phan

[57] ABSTRACT

A refillable dispenser for housing and dispensing one or more sheet materials packaged in boxed or roll form. Dispenser (10) is permanently attached to the underside of an existing cabinet or shelf and is preferably made substantially from wood to match the style and decor of kitchen cabinets. The dispenser is characterized by horizontally spaced vertical side panels (14) supportably attached to a pair of support beams (12), which are also are used to secure the dispenser to the cabinet. One of the side panels supports a cantilevered bottom shelf (16) extending toward an adjacent side panel such that a dispensing slot is formed. The bottom shelf is inclined from the adjoining panel such that a roll (32) of sheet material is held in place by the inclined bottom shelf and the side panel. The lower end of the adjacent panel supports a vertical serrated cutting edge (18). A door (20) attached with hinges from the support beam serves as an end panel and permits replacement of spent materials. Small tab lengths (17) are formed and hang naturally down from the shelf through the slot and away from the cutting edge. The use of roll supports is not required. Dispensing forces are controlled by the surface finish and material of the bottom shelf.

10 Claims, 6 Drawing Sheets

REFILLABLE SHEET MATERIAL DISPENSER

BACKGROUND

1. Field of Invention

The present invention relates generally to the housing of multiple rolls of thin webs of paper, plastic, foils, and the like, and to the dispension of random lengths by pulling and tearing, and more specifically to an enclosure adapted to be attached to an existing cabinet or structure.

2. Description of Prior Art

Devices, containers, and adapters for holding and dispensing small portions of sheet materials have a long history of development. They generally follow the development and introduction of new sheet materials, particularly wax paper, foil, plastic wrap, paper towels, sandwich bags, and trash bags.

Today, the consumer is now confronted with all of these sheet goods which are usually stored and dispensed individually from inexpensive cardboard cartons which allows for dispensing by a pulling and tearing action accomplished by pulling the shee material against a serrated edge located along one side of the container. Because of the dissimilar properties of the sheet materials, this type of container requires a bewildering multitude of manipulative tasks which must be mastered to beneficially use the dispensed sheet goods. These inherent problems have created a need for improved dispensers. For example, U.S. Pat. No. 4,787,542 to Ruff(1986),and U.S. Pat. No. 4,779,780 to Scharf(1986),and U.S. Pat. No. 4,840,299 to Burns(1989), all address problems related to pulling and paying out of the web, anti-recoiling, and clinging of the plastic wrap.

The problems of storage and inconvenience caused by the multitude of roll products has been addressed by the prior art by combining the dispensing and housing of multiple rolls into a singular dispenser. The early inventions, for example, in U.S. Pat. No. 2,722,387 to Tuttle(1955), and U.S. Pat. No. 2,726,825 to Ziskin et al, (1955), are two roll dispensers, one for wax papers, the other for perforated paper towels. Neither of these styles are suitable for adding storaqe spaoe for more roll produots suoh as plastio wrap and foil.

A three roll dispenser is disclosed in U.S. Pat. No. 3,156,392 to Johannes(1964), but it is suitable only for roll products of approximately the same diameters. Thus it could not dispense the present day paper towel roll with plastic wrap and foil because it is considerably larger in diameter than the other two. It also relies on a pair of nip rollers to feed out the material and adds to the manufacturing costs.

A much simpler three roll dispenser is disclosed in U.S. Pat. No. 3,603,519 to Brown(1969), which features a pair of spaced vertically trays which are swingably connected to the sides to make refilling easy. It is designed to handle one large diameter roll of paper towels but only two of the smaller rolled goods. It also lacks a means for allowing the film end or tab to be grasped and pulled for the next dispensing.

Another three roll dispenser is disclosed in U.S. Pat. No. 4,762,042 to Denter et al(1988), but it features a slidable cutter to remove the dispensed film. Like the prior art, it can only dispense two of the small diameter rolls and one large paper towel roll.

In U.S. Pat. No. 4,645,107 to Norris(1987), a sheet material dispenser that can dispense paper towels and three rolls of food wrap materials, plus dispense food bags is disclosed. It discloses a slidable housing which permits refilling of the products. It also arranges the rolls vertically and horizontally so as to make it compact. This arrangement makes replacement of the spent rolls to be cumbersome, especially if the spent roll is a bottom roll. It is also troublesome to have to frequently remove the entire dispensing box which should prove to be large and heavy when fully loaded. The dispenser also requires the use of eight spindles which must be inserted into the cores of the roll goods and adds to the manufacturing costs. They could easily be misplaced or lost and impair the use of the dispenser.

Another disadvantage of this device is the long leads or tabs that must be threaded into the proper channels for each web path. If the proper dispensing forces which control drag, recoiling, pulling and tearing, are not utilized, then the user will have to remove the rolls and rethread the tabs frequently. In view of the previous discussion on refilling, the invention could present more inconveniences than those it tried to solve.

OBJECTS AND ADVANTAGES

Thus, it is a primary object of the present dispenser to house multiple rolls of household products such as paper towels, wax paper, plastic wrap, aluminum foil, and boxed bags, that is easy and convenient to refill without having to remove the dispenser;

to provide a dispenser that is permanently attached to cabinets;

to provide a dispenser which is readily accessible and facilitates the dispensing actions;

to provide a dispenser with separate compartments and cutting edges so as to provide design features that enhance the dispensing of a particular type of material from that compartment;

to provide a dispenser that provides for proper dispensing forces to control drag, recoil, pulling and tearing;

to provide a dispenser which allows sufficient tab lengths to make dispensing easy;

to provide a low cost, easy to manufacture, dispenser that is attractive and complimentary to a wide range of cabinet styles and wood decor.

DRAWING FIGURES

Figure 1:
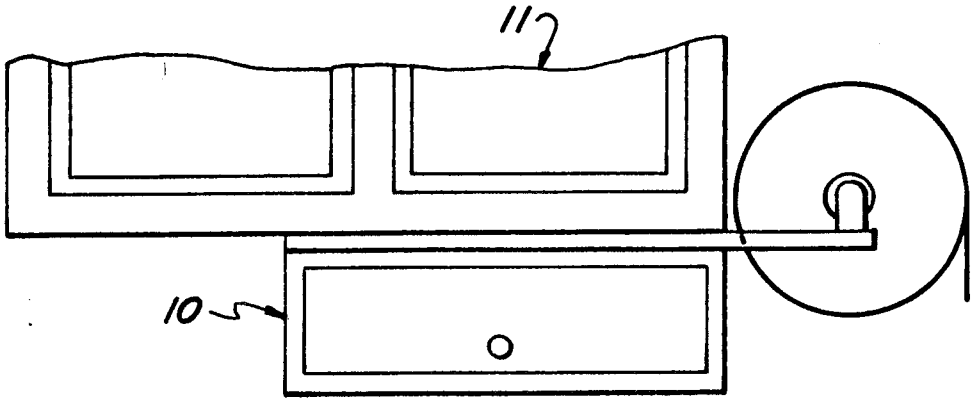
FIG. 1 is a fragmentary front elevation of a cabinet with the refillable sheet material dispenser attached to the underside thereof.

| Reference Numerals in Drawings | |
|---|---|
| 10 | Dispenser |
| 11 | Cabinet |
| 12a | Support beam (rear) |
| 12b | Support beam (front) |
| 14a-14e | Side panel |
| 16a-16d | Bottom shelf |
| 17 | Film end (tab) |
| 18 | Serrated cutting edge |
| 19 | chamfered edge |
| 20 | Door |
| 21 | Horizontal slot |
| 22 | Rear spindle |
| 24 | Front moveable spindle |
| 26 | Spindle hinge |
| 28a, b | Door hinges |
| 30 | Box,sheet goods |
| 31 | Plane angle |
| 32 | Roll, sheet goods |
| 34 | Roll, paper towels |
| 36 | Mounting hole |
| 60 | Prior art dispenser |
| 62 | Rectangular panels of prior art |
| 64 | Roll, film wrap |
| 66 | Cardboard core |
| 68 | Hub |

DESCRIPTION

FIGS. 1-4

Figure 2:
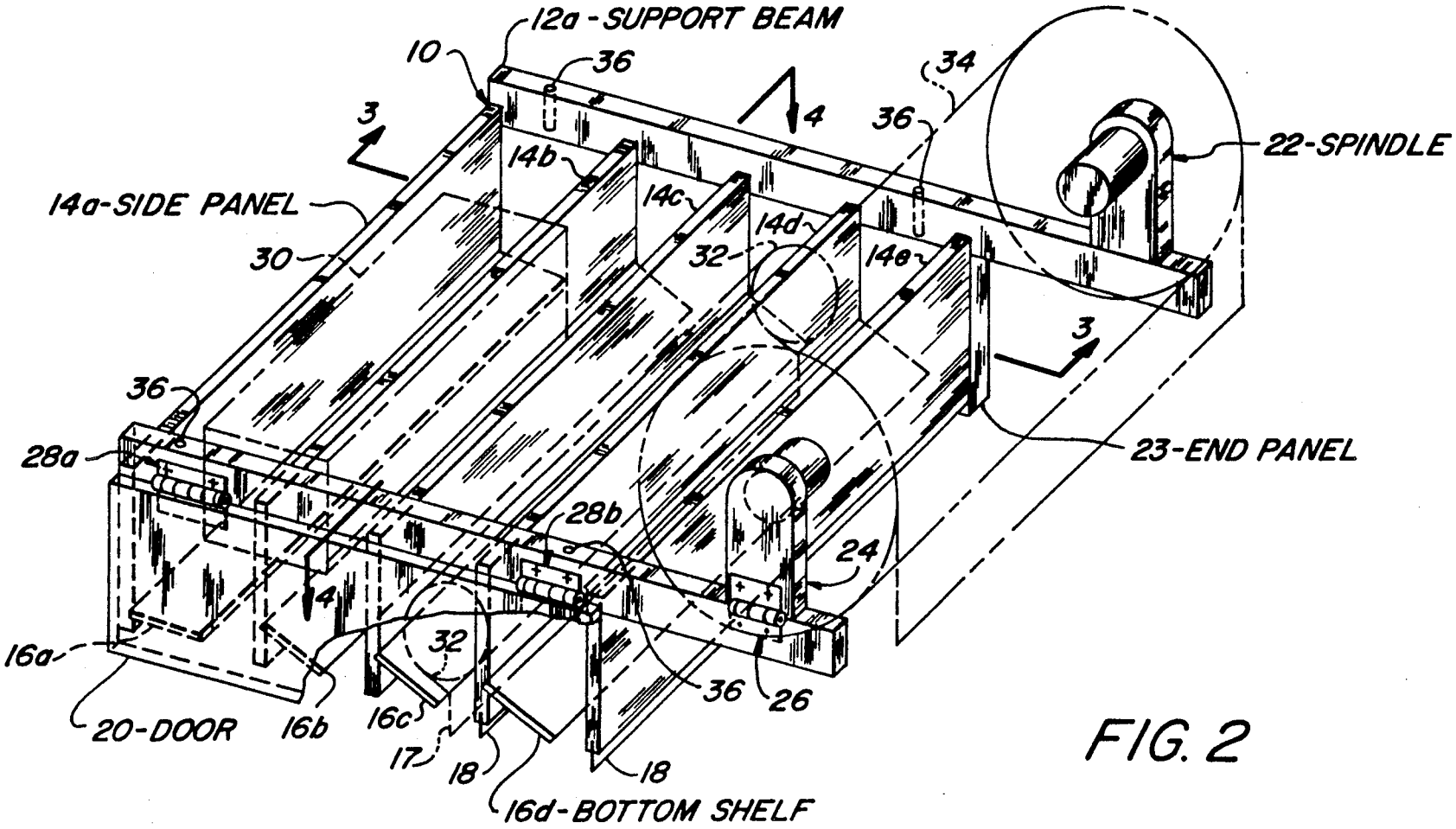
FIG. 2 is a perspective view of a preferred embodiment of the dispenser of this invention shown in the unattached position.
Figure 3:
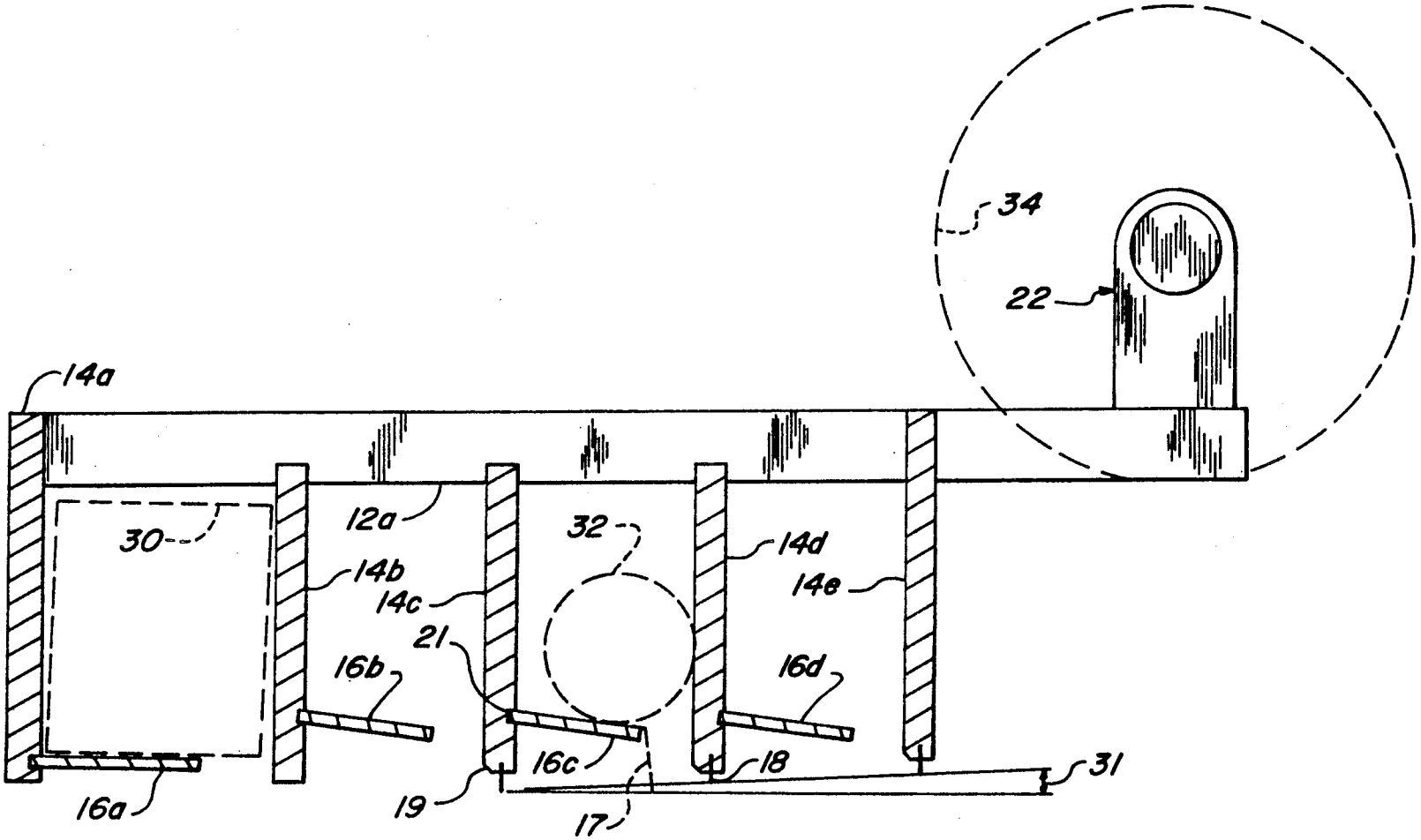
FIG. 3 is a transverse cross sectional view of FIG. 2.
Figure 4:
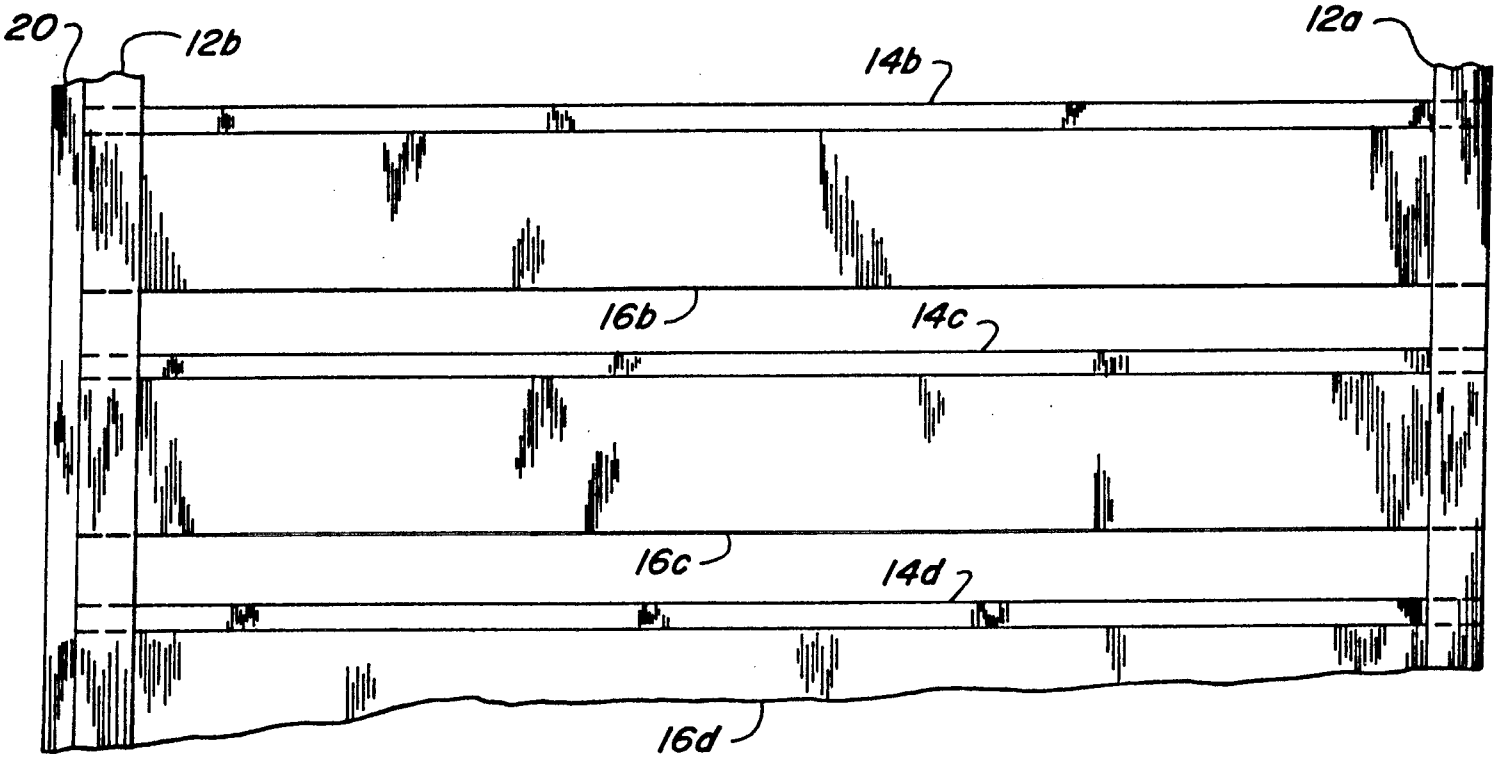
FIG. 4 is a partial longitudinal plan view of the dispenser in FIG. 2.
Figure 6:
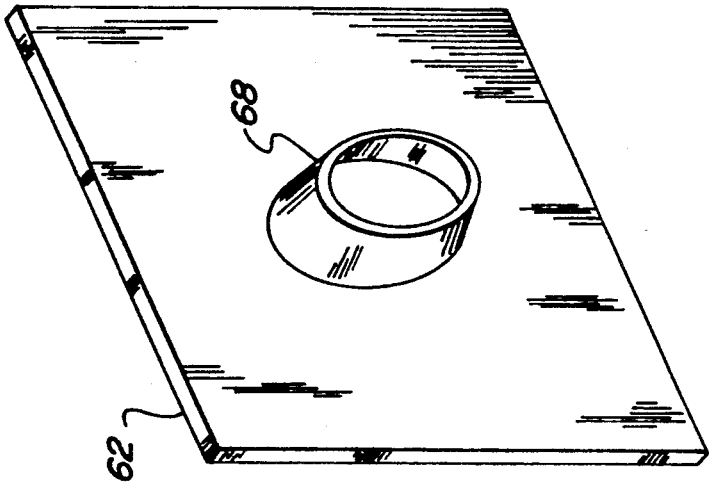
FIG. 6 is a perspective view of a roll support of the prior art in FIG. 5.

A typical embodiment of the invention is shown attached to a kitchen cabinet in FIG. 1. FIG. 2 is a perspective view showing the invention in an unattached condition with four compartments for sheet materials, including a box 30 of sheet materials (bags), a roll 32 of sheet material, and a roll 34 of paper towels. FIG. 3 is a cross sectional elevation view of FIG. 2, and also shows the box 30 of sheet materials, the roll 32 of sheet materials, and the roll 34 of paper towels.

The dispenser 10 is supportably attached to a cabinet 11 by the pair of support beams 12*a* and 12*b* by means of screws through the four mounting holes 36, or by other fastening means such as adhesives or gluing.

Figure 5:
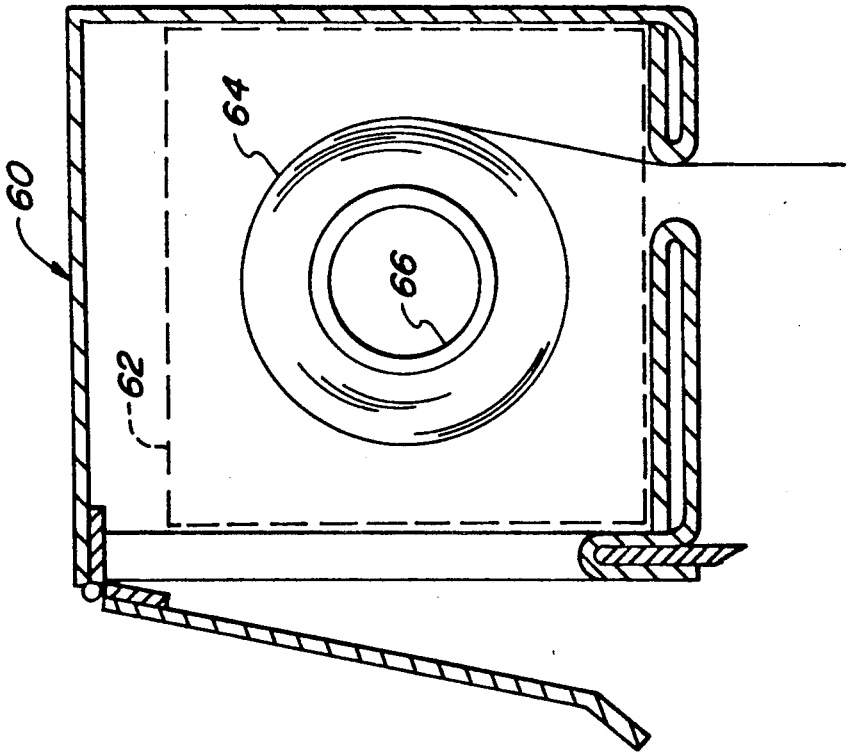
FIG. 5 is a transverse cross sectional view of a prior art.

The support beams 12*a* and 12*b* also support the vertical side panels 14*a*-14*e* which can also be fastened by screws or or glued to the support beams 12 at each end. The wooden side panels 14 contain a horizontal slot 21, slightly angled, on the lower end of the side panels 14 so as to tightly receive the end of the bottom shelf 16 such that a cantilevered plane is formed. Due to the angularity of the slot 21, the shelf 16 makes an obtuse angle with the adjoining side panel 14. The shelf 16 extends slightly downward and towards the adjacent side panel 14 forming a slot or open space along the width of the dispenser. The adjacent side panel 14 is cut with a vertical slot adapted to fit a serrated cutting edge 18 located vertically on the bottom edge of panel 14. Each adjacent cutting edge 18 may be be arranged slightly lower than the preceding edge 18 to form a cutting plane angle 31. The leading edge 19 on the bottom of the side panel 14 is chamfered to permit easy tearing of the sheet material. In FIG. 5, another embodiment shows the bottom shelf 16 extending from a side panel 14 which also supports the cutting edge 18 and allows for the tab 17 to hang down and along side of the panel 14. This embodiment also results in a longer lenth of tab 17.

The side panels 14 are horizontally spaced such they can be made to accomodate a particular brand or style of sheet materials, boxed or rolled.

A door 20 is hingably attached to the front support member 12*b* with hinges 28*a* and 28*b*. The door provides access to each of the compartments for removal and replacement of the sheet materials, and serves as an end panel for the dispenser. A rear end panel, not shown, may be included but is generally not reqluired as the cabinet wall can also serve as the rear end panel. The door 20 and the side panels 14 are preferably substantially of wood so as to match the color, style, and grain of the cabinet attached thereof. The interior sides of the panel 14 and the bottom shelf 16 are of materials and have surface finishes that produce desirable frictional forces.

A pair of spindles 22 and 24 are also supported from the support beams 12*a* and 12*b* for holding and dispensing a roll of paper towels or other suitable sheet goods. The rear spindle 22 is permanently attached to the rear member 12*a*, while the front spindle 24 is hingably attached with a hinge 26 so as to permit removal and replacement of the spent sheet materials.

While the preferred embodiment of the invention shown in FIG. 1 to FIG. 3 show the paper towel spindles 22 and 24 supported above the beams 12, other embodiments could locate the roll 34 below the member 12 or adjacent to the last side panel 14*e*. Other styles of movable spindles or rods for securing the roll 34 may also be used.

It should now be understood that while this particular preferred embodiment of the invention houses and dispenses five sheet materials, the invention is suitable for dispensing one product to as many produots as space permits.

From the above description, a number of advantages of my dispenser becomes evident:

(a) Any number of rolls or boxes of sheet goods can be utilized in an embodiment (b) Each sheet material can be easily replaced by simply opening a door and inserting a new box or roll (c) Different width and diameter of sheet materials can be stored (d) Roll spindles are not required (e) The housing may be rotated 90 degrees horizontally, such that a roll axis is parallel to the rear wall, and provides for dispensing of rolls wider than the width of the cabinet attached thereof.

(f) The dispenser is economical and simple to manufacture

Operation - FIG. 5-FIG. 8

The manner of using the invention is similar to dispensers of the pulling and tearing type but it has some distinctive advantagtes over the prior art. First, since no roll spindles are required and used with the rolls of wax paqper, foil or Saran wrap, the rolls can be removed their cardboard dispenser container and slid directly into a dispensing compartment. And secondly, only a small portion of the film end or tab 17 is required to hang down from the bottom shelf 16.

Figure 8:
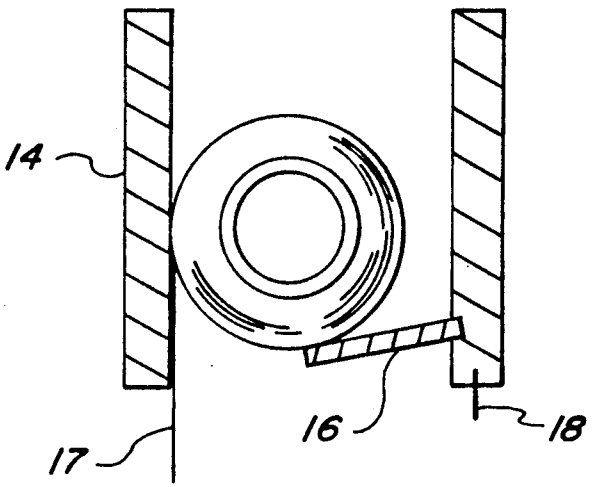
FIG. 8 is a transverse cross sectional view of another preferred embodiment of the present invention.

FIG. 8 shows another embodiment wherein the bottom shelf 16 forms a dispensing slot opposite from the cutting edge 18. A longer tab 17 length is created and is positioned farther away from the cutting edge. The roll is positioned differently such that the tab 17 now extends down the side panel, not folded over the shelf 16 as in FIG. 3. This location of the tab changes the frictional forces on the roll and changes the dispensing action.

Figure 7:
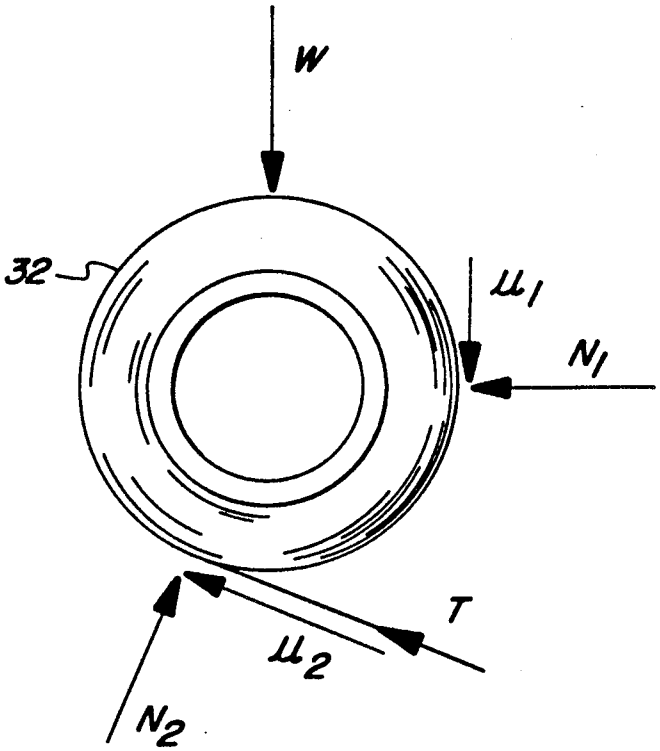
FIG. 7 is a free body diagram showing the frictional and gravitational forces acting on a roll during a dispensing action.

When a roll 32 is placed in a compartment, gravity forces it to roll down the inclined bottom shelf 16 and is held in place by contact forces Nl and N2 shown in FIG. 7. These contact forces help secure the roll during dispensing and keep it from moving from end to end. As the roll decreases with useage, the roll continues to stay positioned over the dispensing slot.

For comparison with similar prior art, in U.S. Pat. No. 4,779,780 to Scharf(1987), FIG. 5 shows a cross sectional view of this dispenser for plastic films. The roll 64 must first be equipped with the rectangular panels 62. The hub 68 on each panel 62 is inserted into the ends of the cardboard core 66. The roll 64 is now placed into the dispenser 60 and drops into place behind a longitudinal panel securing it in place. All rotating frictional forces occur at core 66 and the hub 68. Also note the long tab that remains after dispensing. While it serves a useful function, it can also be unsightly in the view of the consumer.

To further appreciate the advantages of my invention the forces acting on a roll of sheet material during a dispensing action must be understood. A free body diagram of the forces acting on the roll 32 is shown in FIG. 7. The force W is a gravitational force due to weight. The force T is a tension force in opposition to a pulling force. Frictional forces are acting normal to the contact forces N1 and N2.

Friction forces are expressed by the equation F=UN where U is called the coefficient of friction. It is widely known in the art, that the coefficient of friction depends on the materials sliding over each other and on the finished condition of the surfaces of the materials.

Applying the laws of friction to the invention, the frictional forces are F1=U1N1 and F2=U2N2. Since these forces control the dispensing actions of the rolled products, the dispensing actions can be controlled by the surface conditions and materials used at the contact points. Also by changing the obtuse angle of the shelf 16, the magnitude of the forces can be changed.

In the process of dispensing aluminum foil, waxed papers, and plastic film, each material causes different frictional forces to act on the roll and affect the dispensing properties of that particular sheet material. This explains some of the difficulty the art has encountered with plastic films such as Saran wrap.

The said invention easily incorporates the use of different film materials by using a bottom shelf of a particular material such as wood or polyvinyl chloride (pvc) sheet and/or altering the surface finishes by sanding, scoring, knurling, etc. One particular material found useful on saran film is a mill roughened finish of wood commonly known as masonite.

Another advantage of the present invention is that a small tab length about ½ inch extends down natuarally. It is easy to grasp and the fingers are kept away from the cutting edge. The short tabs are hidden behind the door 20 which is purposely made to extend beneath the cutting edge 18. With many roll products, the visible tabs would look unsightly and messy.

Another advantage of the invention is that it is readily adapted to be dispensed by tearing from left to right, and right to left. While most people are right handed and prefer to tear from left to right, left handed people, comprising about 10% of the population prefer to tear from right to left. This feature also permits more user convenience by allowing a wider range of installation locations.

In another embodiment, the dispenser can be rotated 90 degress horizontally and the dispensing action would be from the rear to front.This embodiment is particularly useful for rolls that are wider than the 12 inch cabinet depth. Since most roll products are also available in 18 inch wide rolls, the preferred embodiment would not be suitable for housing 18 inch rolls. By rotating the embodiment 90 degress horizontally and aligning the compartments from rear to front such that the door is at either side, another embodiment can be employed.

From the above description of the operational features of the invention a number of advantages of the dispenser becomes evident:

(a) The spent materials are easily replaced without removing the other sheet goods.

(b) Right handed or left handed dispensing can be utilized.

(c) Different widths and diameter roll products can be dispensed.

(d) The dispensing actions can be easily controlled by the material and contact surface finsish of the bottom shelf.

(e) Tab lengths occur naturally and are of sufficient length, but are not unsightly.

(f) The dispenser is economical and simple to manufacture.

I claim:

1. A sheet material dispenser for locating beneath a wall cabinet and unmovably supporting and dispensing multiple rolls of rolled sheet materials comprising:

(a) an attachment means for securing said dispenser beneath a cabinet comprising a plurality of horizontal support members;

(b) compartments for receiving the sheet material comprising horizontally spaced, vertical side panels, supportably attached transversely to said horizontal support members, a bottom panel cantilvered from each of said side panels and extending toward one adjacent said side panels and defining a longitudinal slot forming a dispensing slot, said compartments are substantially aligned in a horizontal plane so as to substantially align the respective rolled sheet materials in a horizontal plane;

(c) a cutting means for separating a portion of the sheet material comprising a serrated cutting edge, supportably attached to the bottom edge of each said side panels;

(d) a door for removing and replacing the rolled sheet materials wherein said door is placed vertically and perpendicular to said side panels, thereby forming a front end panel of the dispenser and restricting the axial motion of the roll materials during a dispensing and tearing operation.

2. A multiple roll dispernser of claim 1, wherein said horizontal support members are extended longitudinally beyond said door and provided with a holding means for a roll of sheet material whereby the roll is visibly exposed.

3. A multiple roll dispenser of claim 1, wherein the cutting edges lie in a plane that is inclined with respect to a horizontal plane so as to facilitate the dispensing operation.

4. A multiple roll dispenser of claim 1 wherein at least one of said compartments is suitable for receiving boxed sheet materials such as sandwich bags.

5. A multiple roll dispernser of claim 1, which is substantially made from wood.

6. A sheet material dispernser for locating beneath a cabinet and unmovably supporting and dispensing multiple rolls of rolled sheet material comprising:

(a) an attachment means for securing said dispenser beneath a cabinet comprising a plurality of horizontal support members;

(b) compartments for receiving the sheet material comprising horizontally spaced, vertical side panels, supportably attached transversely to said horizontal support members, a bottom panel cantilvered from each of said side panels and extending toward one adjacent said side panels and defining a longitudinal slot forming a dispensing slot, said compartments are substantially aligned in a horizontal plane so as to substantially align the respective rolled sheet materials in a horizontal plane, an end panel that restricts the axial movement of the sheet materials;

(c) a cutting means for separating a portion of the sheet material comprising a serrated cutting edge, supportably attached to the bottom edge of each said side panels;

(d) a door for removing and replacing the rolled sheet materials wherein said door is placed vertically and perpendicular to said side panels, thereby forming another end panel of the dispernser for restricting the axial motion of the roll material during a dispensing operation.

7. A multiple roll dispernser of claim 6, wherein the cutting edges lie in a plane that is inclined with respect to a horizontal plane so as to facilitate the dispensing operation.

8. A multiple roll dispernser of claim 6, wherein at least one of said compartments is suitable for receiving boxed sheet materials.

9. A multiple roll dispenser of claim 6, which is substantially made of wood.

10. A multiple roll dispernse of claim 6 whereby one of said end panels is continuous with a door of said cabinet.

* * * * *